US008833671B2

(12) United States Patent
Cox et al.

(10) Patent No.: US 8,833,671 B2
(45) Date of Patent: Sep. 16, 2014

(54) SUSPENDED RAIL FASTENING APPARATUS

(75) Inventors: Stephen John Cox, Richmond (GB); Andrew Garwood, Sheffield (GB); Keith Poole, Woking (GB)

(73) Assignee: Pandrol Limited, Surrey (GB)

( * ) Notice: Subject to any disclaimer, the term of this patent is extended or adjusted under 35 U.S.C. 154(b) by 1096 days.

(21) Appl. No.: 12/095,467

(22) PCT Filed: Oct. 26, 2006

(86) PCT No.: PCT/GB2006/003984

§ 371 (c)(1),
(2), (4) Date: May 29, 2008

(87) PCT Pub. No.: WO2007/071895

PCT Pub. Date: Jun. 28, 2007

(65) Prior Publication Data

US 2009/0224063 A1 Sep. 10, 2009

(30) Foreign Application Priority Data

Dec. 20, 2005 (GB) ..... 0525883.5

(51) Int. Cl.
*E01B 9/00* (2006.01)
*E01B 9/60* (2006.01)

(52) U.S. Cl.
CPC ..... *E01B 9/60* (2013.01)
USPC ..... 238/336; 238/338

(58) Field of Classification Search
USPC ..... 238/310, 336, 338, 361, 362, 364
See application file for complete search history.

(56) References Cited

U.S. PATENT DOCUMENTS

| | | | | | |
|---|---|---|---|---|---|
| 1,274,118 | A | * | 7/1918 | Wedgeworth | 238/304 |
| 1,333,894 | A | * | 3/1920 | Bennett | 238/364 |
| 1,466,159 | A | * | 8/1923 | Calderon | 238/305 |
| 1,571,008 | A | * | 1/1926 | Hilpert | 238/282 |
| 1,709,731 | A | * | 4/1929 | McGrew | 238/304 |

(Continued)

FOREIGN PATENT DOCUMENTS

| | | |
|---|---|---|
| DE | 31709 | 10/1884 |
| DE | 117632 | 3/1899 |

(Continued)

OTHER PUBLICATIONS

GB Search Report dated Mar. 22, 2006 for Application No. GB0525883.5.

(Continued)

*Primary Examiner* — Jason C Smith
(74) *Attorney, Agent, or Firm* — Husch Blackwell LLP

(57) ABSTRACT

Railway rail fastening apparatus, for suspending a railway rail at discrete locations along its length above a rail foundation, comprises two rail suspending assemblies located when in use one on each side of the rail. Each assembly comprises an elastic member for supporting the head of the rail on one side thereof and a bracket for applying a lateral clamping force to the elastic member. The rail suspending assembly on one side of the rail is located such that the center line of the assembly is offset with respect to that of the rail suspending assembly on the other side of the rail by x mm along the longitudinal axis of the rail, where x is 50≥x>0 mm.

11 Claims, 3 Drawing Sheets

(56) References Cited

U.S. PATENT DOCUMENTS

| | | | | | |
|---|---|---|---|---|---|
| 1,813,941 | A | * | 7/1931 | Loughridge | 238/299 |
| 2,072,871 | A | * | 3/1937 | Edwards | 238/195 |
| 2,905,391 | A | * | 9/1959 | Appleton | 238/315 |
| 3,525,472 | A | * | 8/1970 | Sato | 238/151 |
| 4,770,342 | A | * | 9/1988 | Farrell et al. | 238/347 |
| 4,775,103 | A | * | 10/1988 | Ortwein | 238/283 |
| 5,104,041 | A | * | 4/1992 | Remington | 238/292 |
| 6,079,631 | A | * | 6/2000 | Ortwein et al. | 238/283 |
| 6,293,473 | B1 | * | 9/2001 | Ortwein et al. | 238/2 |
| 6,308,897 | B1 | * | 10/2001 | Remington et al. | 238/292 |
| 6,651,897 | B1 | * | 11/2003 | Porrill et al. | 238/310 |
| 7,641,128 | B2 | * | 1/2010 | Remington et al. | 238/333 |
| 2009/0224063 | A1 | * | 9/2009 | Cox et al. | 238/336 |

FOREIGN PATENT DOCUMENTS

| | | | |
|---|---|---|---|
| DE | 40 07 937 | A1 | 9/1991 |
| DE | 90 07 733.4 | | 11/1994 |
| EP | 0 758 418 | B1 | 5/1998 |
| GB | 529192 | A | 5/1939 |
| WO | WO 01/06061 | A1 | 1/2001 |

OTHER PUBLICATIONS

International Search Report dated Dec. 15, 2006 for International Application No. PCT/GB2006/003984 and Written Opinion of ISA/European Patent Office.

* cited by examiner

SUSPENDED RAIL FASTENING APPARATUS

The present invention relates to railway rail fastening apparatus for suspending a railway rail above a rail foundation.

Figure 1A:
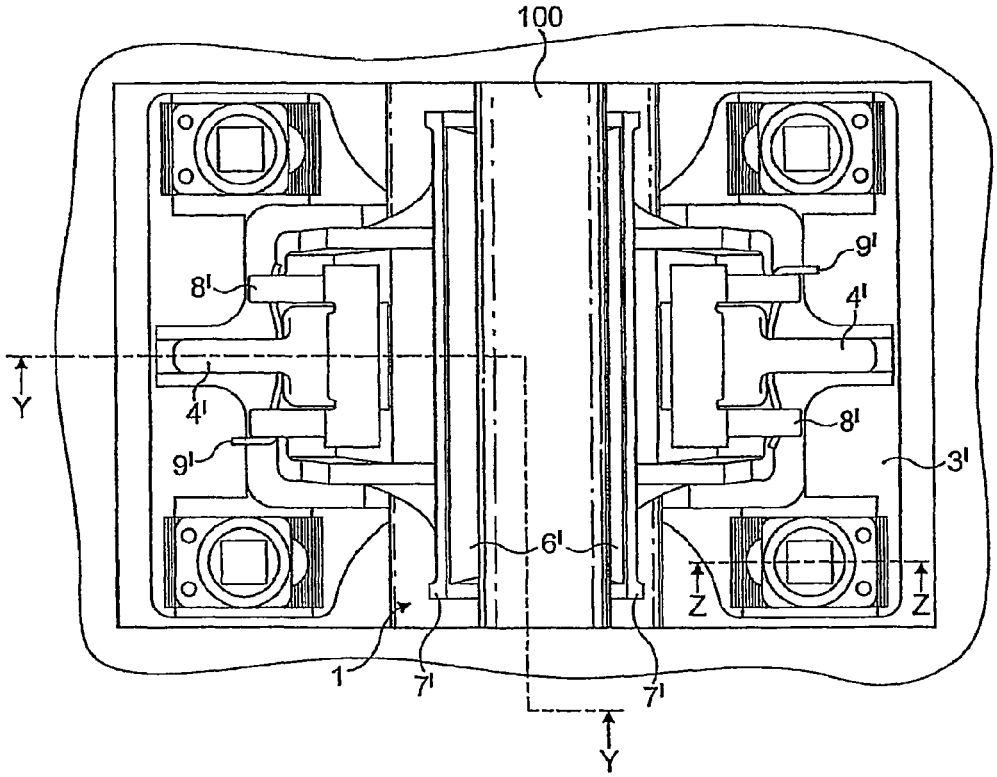
FIG. 1A (PRIOR ART)
Figure 1B:
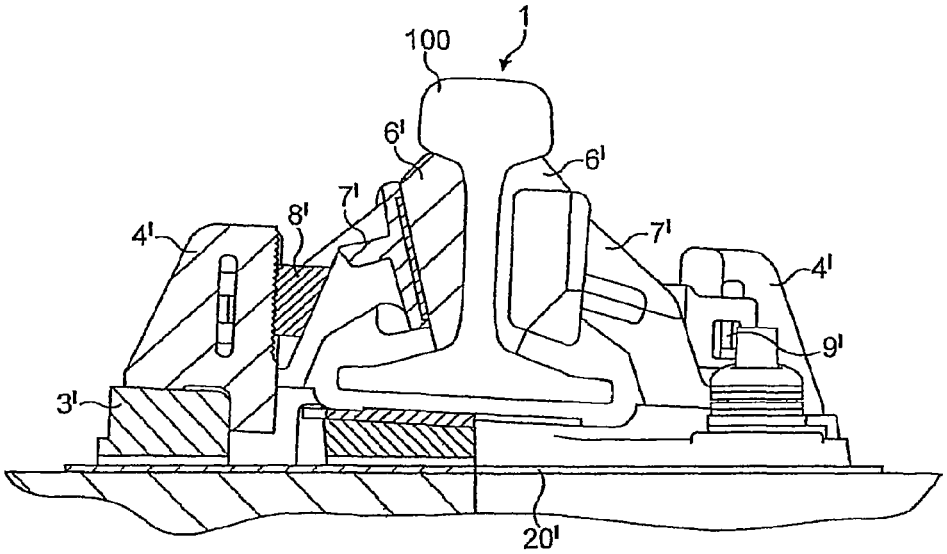
FIG. 1B (PRIOR ART)

EP 0758418B discloses railway rail fastening apparatus for suspending a railway rail at discrete locations along its length above a rail foundation. As shown in FIGS. 1A and 1B of the accompanying drawings, this apparatus comprises a baseplate 3' having a rail seat region 20' above which a railway rail 1 is suspended when the apparatus is in use and two shoulders 4' located one on each side of the rail seat region 20'. The apparatus further comprises two rail suspending assemblies 5' located when in use one on each side of the rail 1, each assembly 5' comprising an elastic member 6' for supporting the head 100 of the rail 1 on one side thereof, a bracket 7' for applying a lateral clamping force to the elastic member 6', a wedge member 8' located when in use between associated one of the shoulders 4' and the bracket 7' for maintaining the lateral clamping force, and a clip 9' for securing the wedge member 8' on the shoulder 4'.

An important factor in such a suspended railway rail apparatus is the degree to which the apparatus resists longitudinal creep of the railway rail therethrough. Although the performance of the apparatus disclosed in EP 0758418B is very good in this regard, improved performance would be an advantage.

According to an embodiment of the present invention there is provided railway rail fastening apparatus for suspending a railway rail at discrete locations along its length above a rail foundation, the apparatus comprising: two rail suspending assemblies located when in use one on each side of the rail, each assembly comprising an elastic member for supporting the head of the rail on one side thereof and a bracket for applying a lateral clamping force to the elastic member; wherein the rail suspending assembly on one side of the rail seat region is located such that the centre line of the assembly is offset with respect to that of the rail suspending assembly on the other side of the rail by x mm along the longitudinal axis of the rail, where x is $50 \geq x > 0$ mm.

The apparatus may further comprise two shoulders, located one on each side of a rail seat region of the rail foundation, above which the railway rail is suspended when the apparatus in use, each rail suspending assembly further comprising a wedge member located when in use between an associated one of the shoulders and the bracket of that assembly, thereby to maintain the said lateral clamping force. In this case, the rail suspending assembly and shoulder on one side of the rail seat region are located such that the centre line of the assembly and shoulder is offset with respect to that of the rail suspending assembly and shoulder on the other side of the rail seat region by x mm along the longitudinal axis of the rail, where x is $50 \geq x > 0$ mm.

Desirably, x is $30 \geq x > 0$ mm, and preferably x is $30 \geq x \geq 10$ mm.

Even more desirably, x is $25 \geq x > 0$ mm, more preferably x is $25 \geq x \geq 10$ mm, and even more preferably $x = 25$ mm.

Surprisingly, providing a longitudinal offset of a limited distance between the centre line of the rail suspending assembly on one side of the rail seat region with respect to that of the rail suspending assembly on the other side of the rail seat region provides improved resistance to creep of the rail. For example, if there is no offset at all, the longitudinal resistance to creep is 14.76 kN for a particular assembly, whereas an offset of 25 mm provides increased resistance to creep of 16.95 kN, but at an offset of 90 mm creep resistance is negligible.

Reference will now be made, by way of example, to the accompanying drawings, in which:

FIGS. 1A and 1B (described above) show plan and part cross-sectional views respectively of conventional suspended rail fastening apparatus; and FIGS. 2A to 2D show respective plan, part cross-sectional, side and perspective views of a railway rail fastening apparatus embodying the present invention.

Figure 2A:
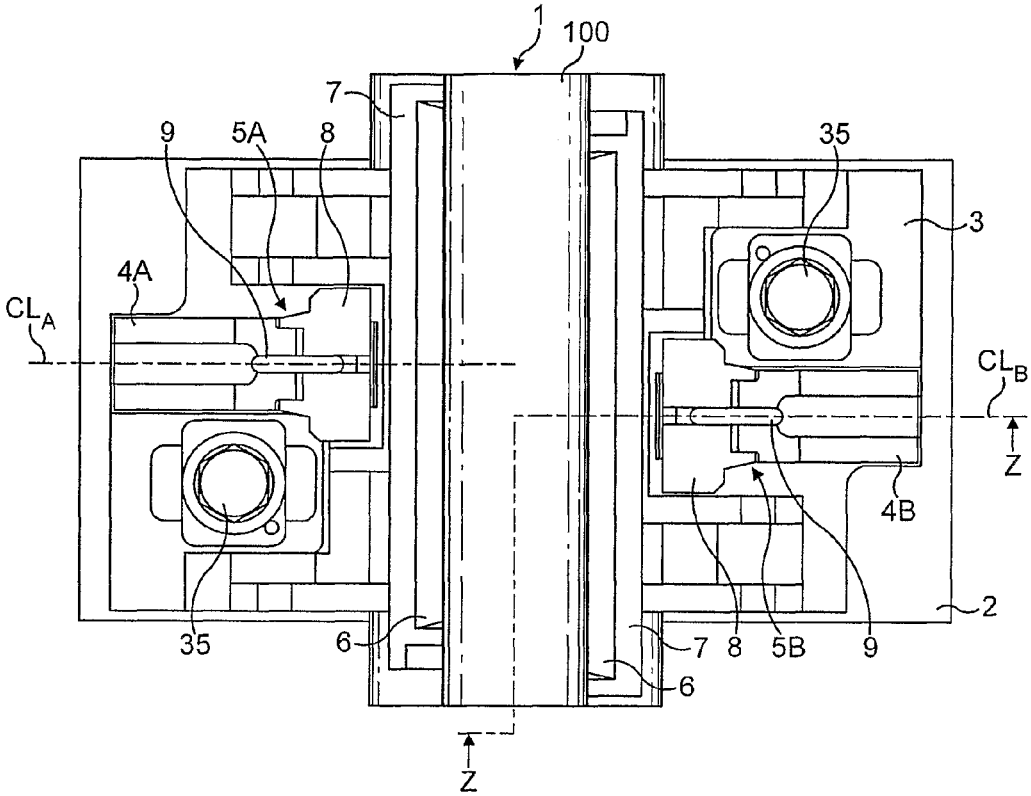
Figure 2B:
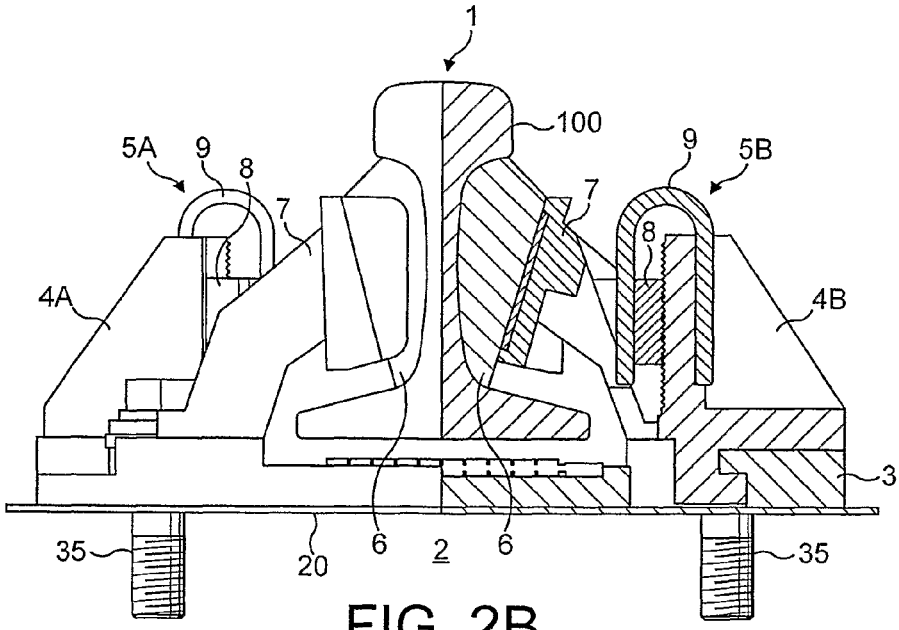
Figure 2C:
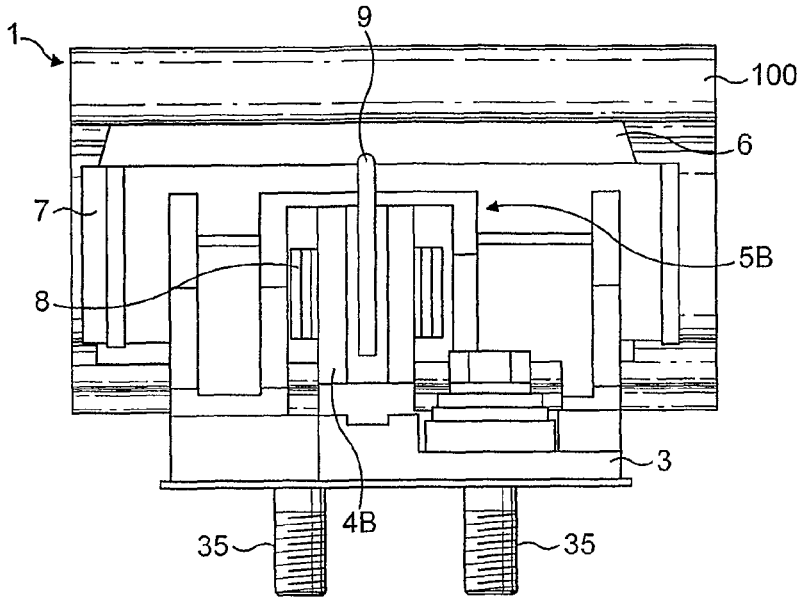
Figure 2D:
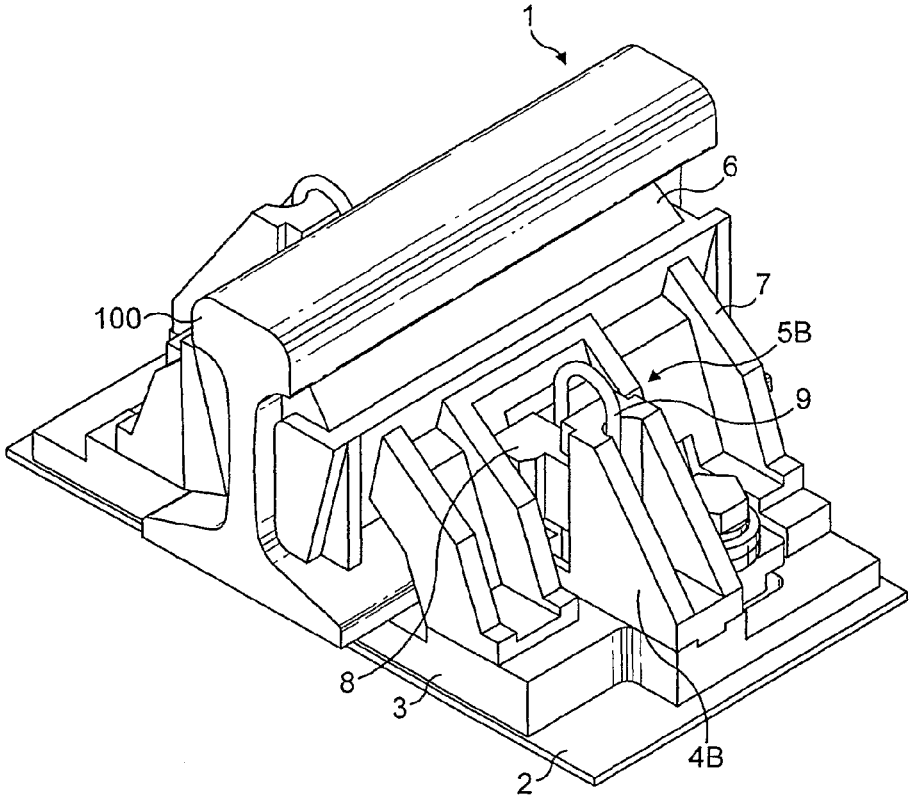

Apparatus embodying the present invention comprises two shoulders 4A, 4B located one on each side of a rail seat region 20 of a rail foundation 2. A railway rail 1 is suspended above the rail seat region 20 by means of two rail suspending assemblies 5A, 5B located one on each side of the rail 1, each assembly 5A, 5B comprising an elastic member 6 made of rubber or similar material for supporting the head 100 of the rail 1 on one side thereof, a bracket 7 for applying a lateral clamping force to the elastic member 6, and a wedge member 8 located when in use between an associated one of the shoulders 4A, 4B and bracket 7 for maintaining the lateral clamping force. The wedge member 8, which preferably has a serrated face which engages with a serrated face on a rail-facing surface of the associated shoulder 4A, 4B is held in place within the assembly 5 by means of a clip 9. The clip 9 comprises an approximately U-shaped bar of round cross-section which, in use, lies in a substantially vertical plane. FIG. 2A shows that a centre line $CL_A$ of the rail suspending assembly 5A and shoulder 4A on one side of the rail 1 is offset along the longitudinal axis of the rail 1 from the centre line $CL_B$ of the rail suspending assembly 5B and shoulder 4B on the other side of the rail 1.

FIGS. 2A to 2D illustrate an embodiment in which the shoulders 4 hook in to a baseplate 3 which is secured to the rail foundation 2 by two offset bolts 35. This is advantageous, since such a baseplate may be retrofitted to an existing rail foundation already having two offset bolt-receiving holes. However, it is also advantageous to employ an embodiment of the invention in a new rail installation, with or without a baseplate.

The invention claimed is:

1. A railway rail fastening apparatus for suspending a railway rail (1) at discrete locations along its length above a rail foundation (2), the apparatus comprising:

two rail suspending assemblies (5A, 5B) located when in use one on each side of the rail (1), each assembly (5A, 5B) comprising an elastic member (6) for supporting the head of the rail (1) on one side thereof and a bracket (7) for applying a lateral clamping force to the elastic member (6);

wherein the rail suspending assembly (5A) on one side of the rail seat region is located such that the centre line ($CL_A$) of the assembly (5A) is offset with respect to that ($CL_B$) of the rail suspending assembly (5B) on the other side of the rail (1) by x mm along the longitudinal axis of the rail (1), where $50 \geq x \geq 10$ mm.

2. An apparatus as in claim 1, further comprising two shoulders (4A, 4B), located one on each side of a rail seat region of the rail foundation (2), above which the railway rail (1) is suspended when the apparatus in use;

each rail suspending assembly (5A, 5B) further comprising a wedge member (8) located when in use between an associated one of the shoulders (4A, 4B) and the bracket (7) of that assembly (5A, 5B), thereby to maintain the said lateral clamping force;

wherein the rail suspending assembly (5A, 5B) and shoulder (4A, 4B) on one side of the rail seat region are located such that the centre line of the assembly (5A, 5B) and shoulder (4A, 4B) is offset with respect to that of the rail suspending assembly (5A, 5B) and shoulder (4A, 4B) on the other side of the rail seat region by x mm along the longitudinal axis of the rail (1), where 50≥x≥10 mm.

3. An apparatus as in claim 1, wherein 30≥x≥10 mm.

4. An apparatus as in claim 1, wherein 25≥x≥10 mm.

5. An apparatus as in claim 1 wherein x is on the order of 25 mm.

6. A railway rail fastening apparatus for suspending a railway rail at discrete locations along its length above a rail foundation, the apparatus comprising:

at least first and second rail suspending assemblies each locatable on one side of a rail, each assembly includes an elastic member for supporting a head of the rail on one side thereof and a bracket for applying a lateral clamping force to the elastic member, where a center line of one assembly, which intersects the other assembly, is offset with respect to a center line of the other assembly, which intersects the one assembly, by x mm, where 50≥x≥10 mm.

7. An apparatus as in claim 6, which includes two shoulders, located one on each side of a rail seat region of a rail foundation, above which the railway rail is suspended when the apparatus in use;

each rail suspending assembly including a wedge member located between an associated shoulder and the bracket of each assembly to thereby maintain the lateral clamping force;

wherein each rail suspending assembly and respective shoulder is located such that the center lines of each assembly and shoulder are axially offset with respect to one another on the order of x mm where 50≥x≥10 mm.

8. An apparatus as in claim 6, wherein 30≥x≥10 mm.

9. An apparatus as in claim 6, wherein 25≥x≥10 mm.

10. An apparatus as in claim 6, wherein x is on the order of 25 mm.

11. An apparatus as in claim 6, wherein said railway rail has a longitudinal resistance to creep in an amount greater than 14.76 kilonew tons.

* * * * *